US005150090A

United States Patent [19]

Miura et al.

[11] Patent Number: 5,150,090

[45] Date of Patent: Sep. 22, 1992

[54] ELECTROMAGNETIC POLAR RELAY

[75] Inventors: Takashi Miura, Nagano; Yoshiaki Kamiya, Suzaka, both of Japan

[73] Assignee: Fujitsu Limited, Kawasaki, Japan

[21] Appl. No.: 410,822

[22] Filed: Sep. 22, 1989

[30] Foreign Application Priority Data

Sep. 22, 1988 [JP] Japan ..... 63-237806

[51] Int. Cl.[5] ..... H01H 51/22

[52] U.S. Cl. ..... 335/84; 335/78; 335/230

[58] Field of Search ..... 335/78-85, 335/124, 121, 128, 229, 230

[56] References Cited

U.S. PATENT DOCUMENTS 4,727,344 2/1988 Koga et al. ..... 335/78

FOREIGN PATENT DOCUMENTS 0074577 9/1982 European Pat. Off. .
0130423 6/1984 European Pat. Off. .
2191039 2/1986 United Kingdom .

*Primary Examiner*—Leo P. Picard
*Assistant Examiner*—Lincoln Donovan
*Attorney, Agent, or Firm*—Staas & Halsey

[57] ABSTRACT

An electromagnetic polar relay comprising a first yoke having a main portion and first and second ends positioned at respective angles to the main portion; a second yoke, positioned to face the first yoke, having a lower end positioned to face the main portion so that magnetic reluctance between the second yoke and the main portion is larger than a magnetic reluctance between the first end of the first yoke and the main portion; an armature having a first portion movably connected to the second end of the first yoke and having a second portion movable between the first yoke and the second yoke; a coil positioned about the armature; and a permanent magnet, positioned over the main portion, having a first pole magnetically connected to the first end of the first yoke and a second pole magnetically connected to the second yoke. The higher reluctance is due to, for example, an air gap provided by a tapered edge of the second yoke. The difference in magnetic reluctance between the first and second yokes assures that an undesirably large attractive force on the armature by the second yoke is reduced in comparison with previous relay.

16 Claims, 9 Drawing Sheets

FIG. 9(a)
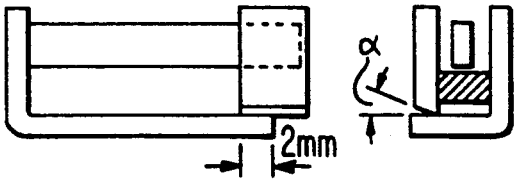
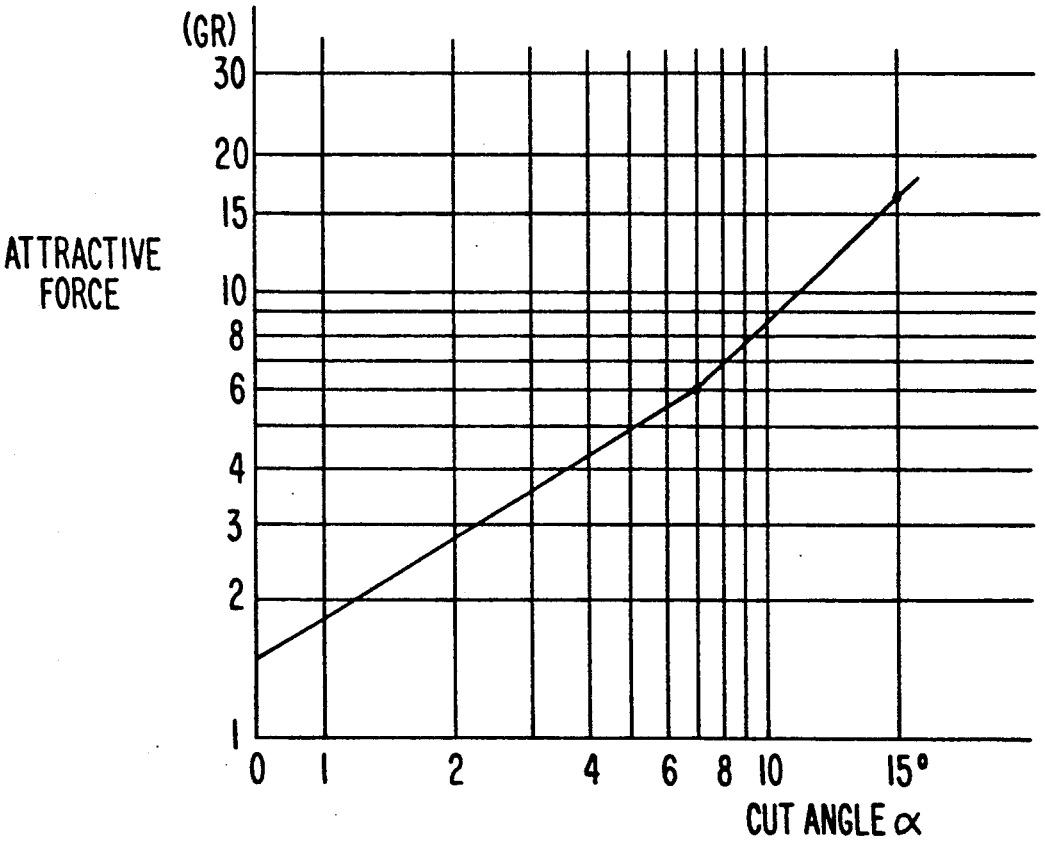
FIG. 9(b)

ELECTROMAGNETIC POLAR RELAY

BACKGROUND OF THE INVENTION

1. Field of the Invention

The present invention relates to a high-sensitivity, thin, miniature, electromagnetic polar relay.

2. Description of the Related Art

The cross-sectional views shown in FIGS. 1(*a*) and 1(*b*) together with the perspective views shown in FIGS. 1(*c*) and 1(*d*) schematically illustrate the structure and operation of a typical electromagnetic miniature polar relay such as disclosed in Japanese Unexamined Patent Publication Toku-Kai-Sho 61-116729. This relay is provided with a coil 1 wound on a bobbin 2, a permanent magnet 6, and an armature 3 which moves due to energization of the coil 1 so as to move contact springs (not shown). The permanent magnet 6 is polarized, for example, as denoted with N and S in FIGS. 1(*c*) and 1(*d*). A non-energized state, where no current is applied in the coil 1, is shown in FIGS. 1(*a*) and 1(*c*). In this state an end 3*a* and an end 3*b* of the armature 3 are moved so as to respectively contact an end 4*a* of an L-shaped yoke 4 and an end 5*a* of a U-shaped yoke 5 due to a magnetic flux 6*a* of the permanent magnet 6. An energized state, where the armature 3 is magnetized due to a current through the coil 1, is shown in FIGS. 1(*b*) and 1(*d*). In this state the direction of the current is such that the induced magnetic field is opposite that of the permanent magnet 6. Therefore, the armature end 3*a* is repelled by the end (N-pole) 4*a* and is attracted onto an end (S-pole) 5*b* of the U-shaped yoke 5, and the other armature end 3*b* is magnetically attracted to contact the other end 5*a* of a U-shaped yoke 5, due to a magnetic flux 1*a* of the coil as shown in FIG. 1(*d*). In this state the armature end 3*b* and the end 5*a* of the U-shaped yoke 5 tend to repel each other; however, they are kept in contact by a leaf spring 7. One end of leaf spring 7 is fixed to the armature 3 as seen in FIGS. 1(*a*) and 1(*b*). After the armature position is switched, the end 3*b* of the armature 3 and the end 5*a* of the yoke 5 are magnetically attracted to each other, and thus contact each other.

Operational characteristics of the FIG. 1 relay are shown in FIG. 2, where the abscissa indicates armature position on its stroke, and the ordinate indicates mechanical force on the armature. In FIG. 2, curve A denotes a load characteristics of the contact spring. That is, curve A represents a mechanical load on the armature during the armature stroke, and more particularly the force tending to push the armature back to the center. This mechanical load is zero at the center of the stroke, and gradually increases as the armature deviates from the center of the stroke due to bending of a contact spring. At kink points K and K' of curve A, a contact on the contact spring begins to touch a stationary contact. Further deviation of the armature towards a magnetic pole 4*a* or 5*b* causes further bending of the contact spring. As indicated by FIG. 2, this further bending requires a layer force.

In FIG. 2, curve B denotes a mechanical force magnetically induced on the armature by the permanent magnet 6. Curve B is shown as a negative force. This means that the force is towards N-pole 4*a*. Curve B must be always below the curve A. The gap between the curves A and B is a margin for variation of various conditions. At the N-Pole 4*a*, the difference $F_B$ between the holding force Fgr and the load $P_B$ indicates a pressure on the contacts, and is a margin that protects tho contacts from external shock or chattering.

A curve C denotes a mechanical force magnetically induced on the armature as a sum of magnetic forces of the permanent magnet 6 and the energized coil 1, to which the current is applied. The direction of this force is opposite that of the magnetic field of the permanent magnet 6. Curve C is shown as a positive force. This means that the force is towards S-pole 5*b*. Curve C must be always above the curve A. When armature 3 is at the S-pole 5*b*, the difference between the holding force Pgr and the mechanical load $P_B'$ indicates a pressure on the stationary contacts and protects the contacts from external shock or chattering.

In an electromagnetic polar relay having structure as described above, the desirable characteristics for achieving a high sensitivity, i.e. low coil energization power, and reliable performance are as follows: Curves B and C must have enough margin (e.q., $F_B'$, $F_8$) with respect to curve A. However, the margin should not be too much, i.e., should be as small as possible. This is because the margin of curve C to curve A requires excessive ampere-turns, i.e. coil power consumption. However, because of magnetic characteristics of some permanent magnet materials the value of curve B (i.e. $F_B$) becomes very large at the N-pole. In order to overcome this large value, the coil requires large ampere-turns which causes high power consumption and a very excessive margin at the S-pole.

SUMMARY OF THE INVENTION

It is a general object of the invention to provide a miniature electromagnetic polar relay requiring low coil actuating power, while maintaining electrical and mechanical durability.

It is another object of the invention to provide a miniature electromagnetic polar relay which is less susceptive to the effects of external magnetic fields.

It is still another object of the invention to provide a miniature electromagnetic polar relay which has reduced variations in relay characteristics.

According to the present invention, an electromagnetic polar relay comprises: a coil; an armature swingably positioned within the coil; a main yoke along an outer side of the coil; a permanent magnet polarized along in the direction of swing of the armature and located along a flat edge of the main yoke; a first pole plate which is a part of the main yoke and is bent orthogonally from the main yoke parallel to an axis of the coil, and is magnetically connected with one pole of the permanent magnet; a second pole plate facing the first pole plate and magnetically connected with another pole of the permanent magnet. An edge of the second pole plate faces the flat end of the main yoke and is magnetically connected with main yoke through a reluctance which is larger than a reluctance between the first pole plate and the main yoke. The high reluctance is due to, for example, an air gap provided by a tapered edge of the second pole plate. An end of the armature is pivotably and magnetically connected to another end of the main yoke. Another end of the armature swings between the first and second pole plates depending on the direction of current within the coil. A magnetic circuit comprising the above-mentioned air gap and a part of the main yoke shunts the permanent magnet, and controls an amount of magnetic flux flowing therethrough. Thus an undesirably large attractive force on the armature by the second pole plate can be reduced, resulting in an reduction of ampere-turn, i.e. power consumption, of the coil while allowing enough margin for the mechanical load characteristics and a reliable contact force. Furthermore, the resulting closed magnetic circuit prevents an external magnetic field from affecting the magnetic characteristics of the relay and prevents variation of the parts comprising the relay from causing variations in the relay characteristics.

The above-mentioned features and advantages of the present invention, together with other objects and advantages, which will become apparent, will be more fully described hereinafter, with reference being made to the accompanying drawings which form a part hereof, wherein like numerals refer to like parts throughout.

BRIEF DESCRIPTION OF THE DRAWINGS

FIGS. 1(*b*) and 1(*d*) respectively, are schematic cross-sectional views of a prior art relay in a non-energized and energized state;

FIG. 6(*b*) schematically illustrates the magnetic polarization of each magnetic pole of FIG. 5, when the coil is energized;

FIG. 7(*b*) schematically illustrates a path of magnetic flux in the magnetic circuit of FIG. 5 when the coil is energized;

FIG. 8(*b*) is a perspective view showing a pivotally connected armature after the armature is inserted into the slot;

FIG. 8(*c*) is a perspective view armature mounted into the yoke has mounted thereon a bobbin;

FIG. 9(*a*) illustrates the cut angle of the taper;

FIG. 9(*b*) is a graph showing an effect of cut angle $\alpha$ of the tapered edge of the second yoke;

DESCRIPTION OF THE PREFERRED EMBODIMENTS

Figure 1A:
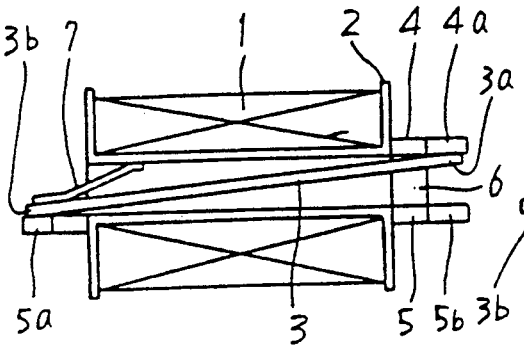
PRIOR ART FIG. 1(a)
FIGS. 1(*a*) and 1(*c*) respectively, are schematic cross-sectional views of a prior art relay in a non-energized and energized state.
Figure 1B:
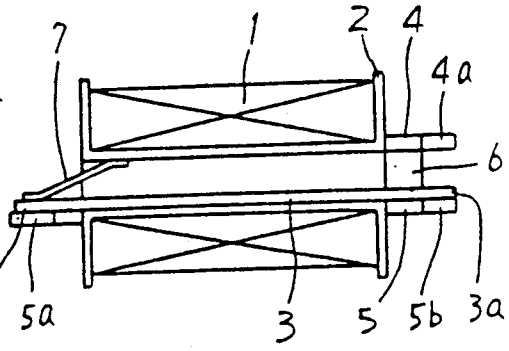
PRIOR ART FIG. 1(b)
Figure 1C:
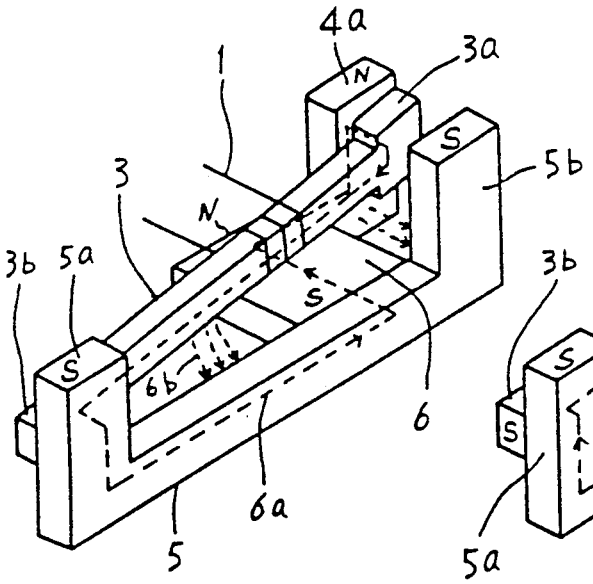
PRIOR ART FIG. 1(c)
Figure 1D:
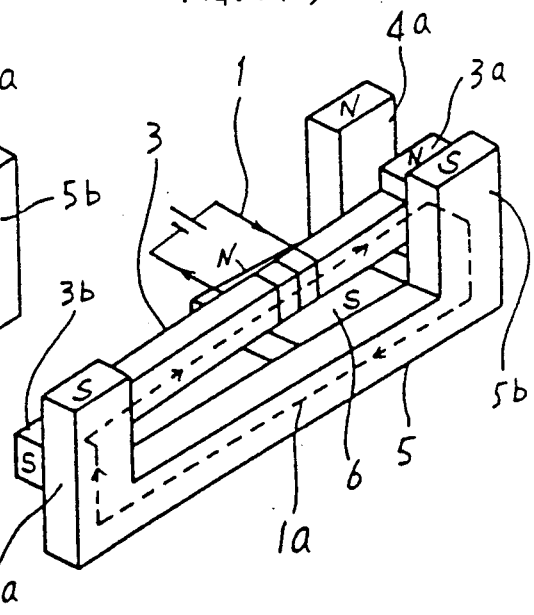
PRIOR ART FIG. 1(d)
Figure 2:
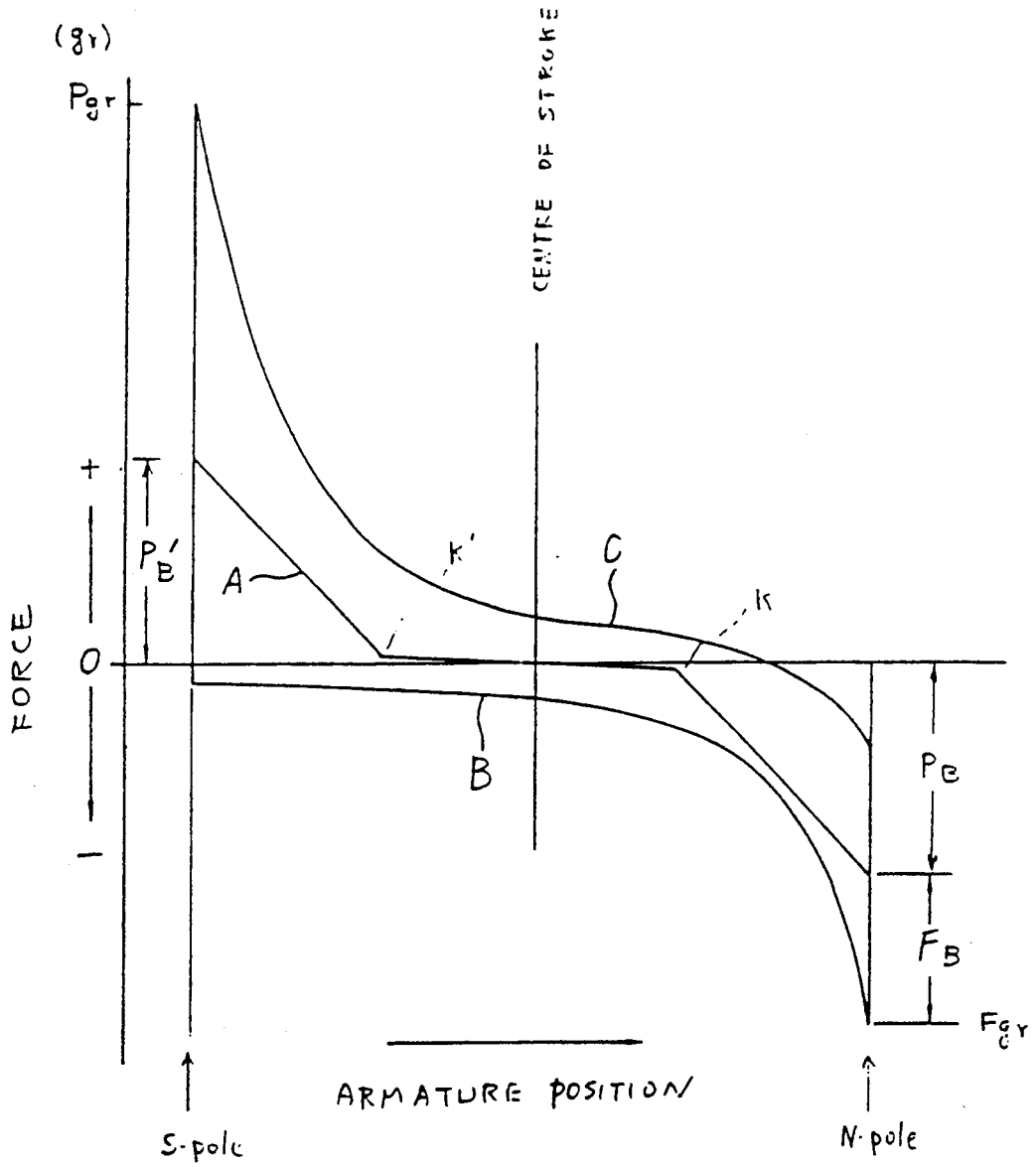
FIG. 2 is a graph representing the mechanical forces versus armature position of the prior art relay of FIGS. 1(*a*)–(*d*)
Figure 3:
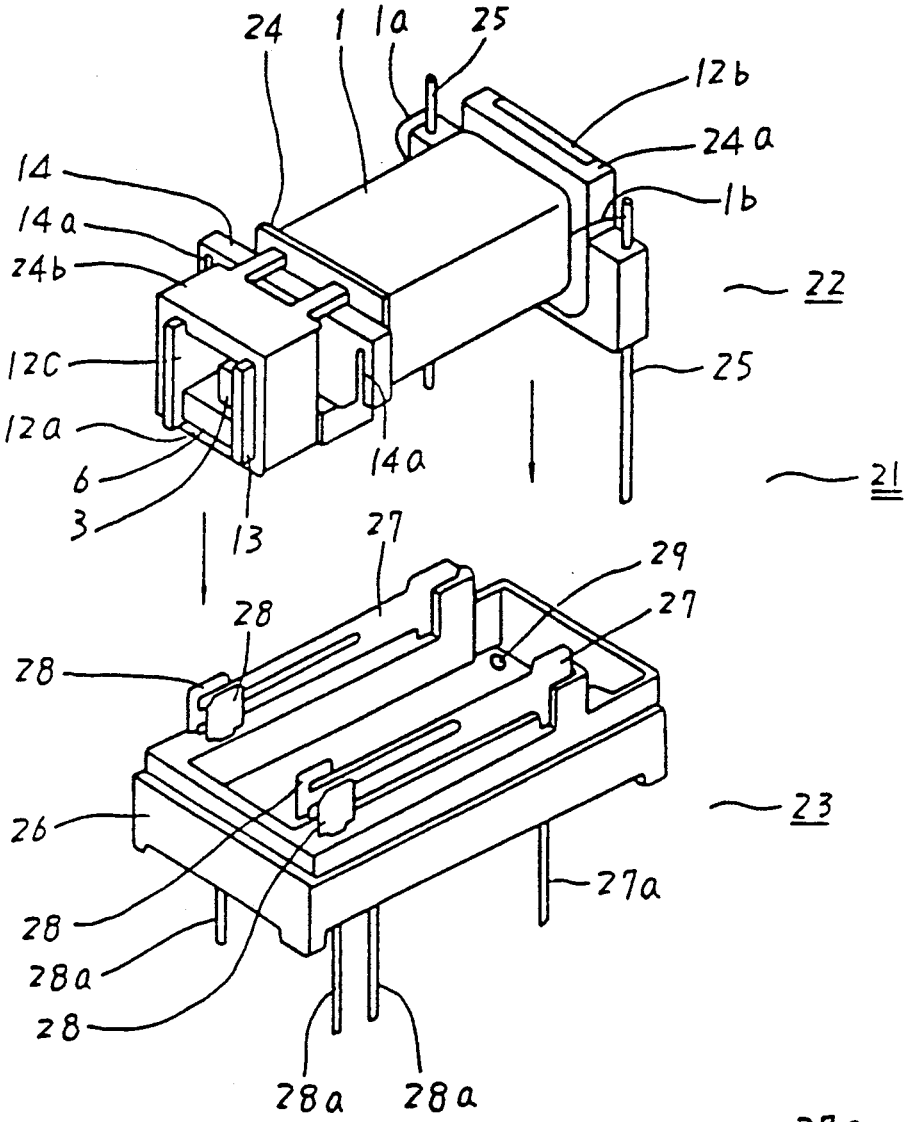
FIG. 3 is a perspective view of an embodiment of a relay according to the present invention.

As schematically illustrated in FIG. 3, an electromagnetic polar relay (referred to hereinafter as a relay) 21 according to the present invention. The relay 21 comprises an electromagnetic circuit sub-assembly 22 and a base sub-assembly 23 having moving-contact springs and stationary contacts thereon.

The electromagnetic circuit subassembly 22 has a bobbin 24 whose main portion is not shown in the figure; and electromagnetic coil (simply referred to hereinafter as coil) 1 wound on the bobbin 24; a permanent magnet 6 for providing a magnetic polarization; an armature 3 made of a soft magnetic material located swingably through a center hole of bobbin 24; a first yoke 12 (*a*), (*b*), (*c*) made of a soft magnetic material and having a structure as described below; a second yoke 13 made of a soft magnetic material; and a card 14, made of a non magnetic material, mechanically engaged with the armature, for delivering a stroke of the armature to moving-contact springs 27 on the base sub-assembly 23. Wire ends 1*a* and 1*b* of coil 1 are each electrically connected to pins 25 planted on a flange 24*a* provided on an end of bobbin 24. A protruding portion 24*b* of another end of bobbin 24 holds an end 12*a* of the main yoke 12 and second yoke 13.

Figure 4:
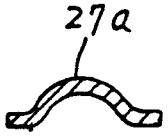
FIG. 4 is a cross-sectional view of a lead employed in the relay of FIG. 3.

The base sub-assembly 23 has a box-shaped insulating substrate 26; a pair of moving-contact springs 27 having first ends respectively planted via leads 27*a* on an edge of the substrate 26; and two pairs of stationary contacts 28 located such that second ends of the moving contact springs 27 are each positioned between a pair of the fixed contacts 28. Leads 27*a* and 28*a* are led out through the substrate 26 of the base. The substrate 26 further has two through-holes 29, into which the pins 25 of the electromagnetic circuit sub-assembly 21 are inserted. Thus, when the electromagnetic circuit sub-assembly 21 is mounted onto the base sub-assembly 23, a pair of vertical slits 14*a* provided on the card 14 engage the moving-contact springs 27 respectively at the middle portion of the moving-contact springs. The moving-contact spring 27 and their leads 27*a* are formed of one piece of approximately 0.1 mm thick plate. The leads 27*a* are longitudinally beaded as shown in a cross-sectional view in FIG. 4 to provide mechanical enforcement.

Figure 5:
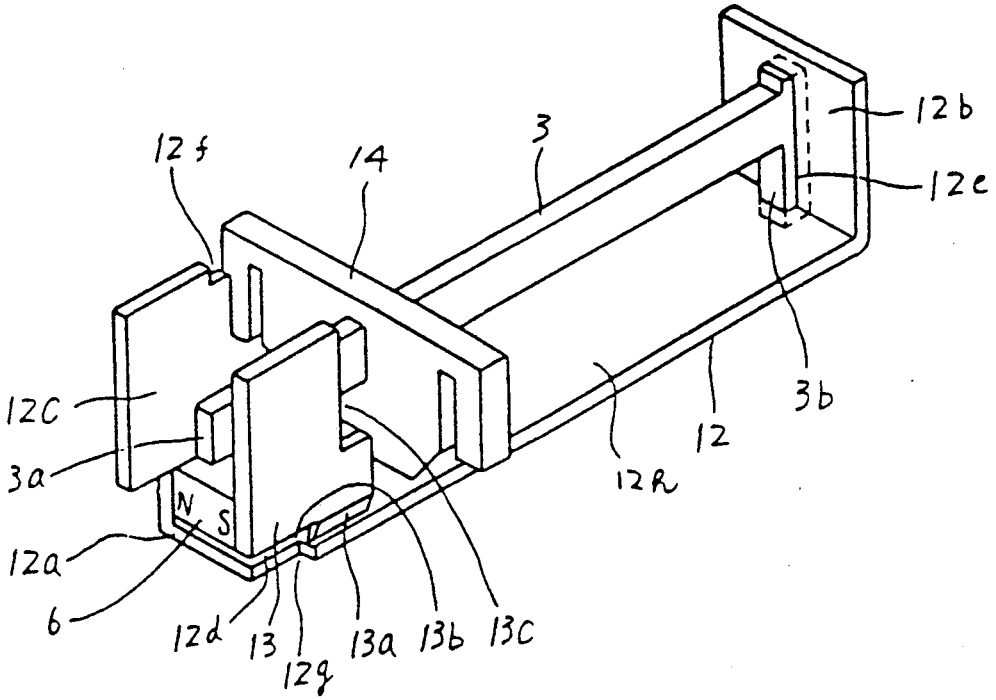
FIG. 5 schematically illustrates a magnetic circuit employed in the relay of FIG.

The magnetic circuit within the electromagnetic circuit sub-assembly 22 is schematically illustrated in FIG. 5, and described below. Ends 12*c* and 12*b* of the first yoke 12 are bent from a flat main portion 12*h* of the first yoke 12. The ends 12*c* and 12*b* form an L-shape with the main portion 12*h* so that the first bent end 12*c* is parallel to the longitudinal axis of the bobbin 24, and the second bent end 12*b* is perpendicular to the longitudinal axis of the bobbin 24 as shown in FIGS. 3, 5, 6(*a*) and 6(*b*).

The permanent magnet 6 is typically formed of a rare-earth metal preferably shaped in a rectangular parallelepiped. The permanent magnet 6 is positioned parallel to a flat end 12*a* of the main portion 12*h* between the first bent end 12*c* and a second yoke 13. As shown in FIGS. 6(*a*) and 6(*b*), the second yoke 13 is parallel to the first bent end 12*c*. There is generally provided a gap between the permanent magnet 6 and the flat end 12*a*. In this example, it is assumed that N-pole of the permanent magnet 6 contacts the first bent end 12*c* and the S-pole contacts the second yoke 13 as shown in FIGS. 6(*a*) and 6(*b*).

Figure 8A:
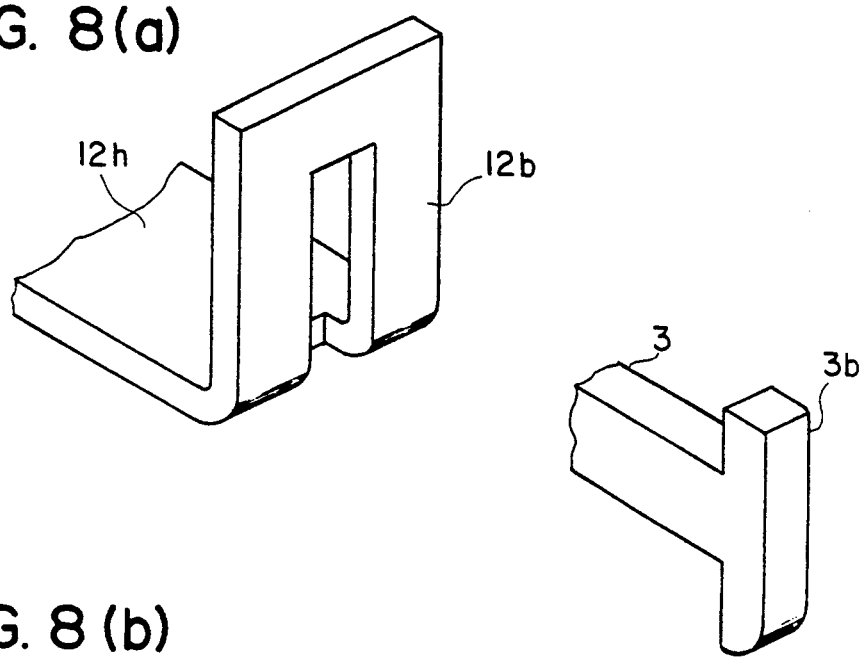
FIG. 8(*a*) is a perspective view showing a pivotally connectable armature before the armature is inserted into the slot.
Figure 8:
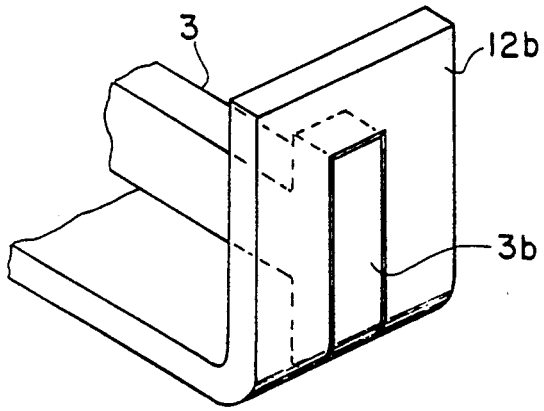
Figure 8:
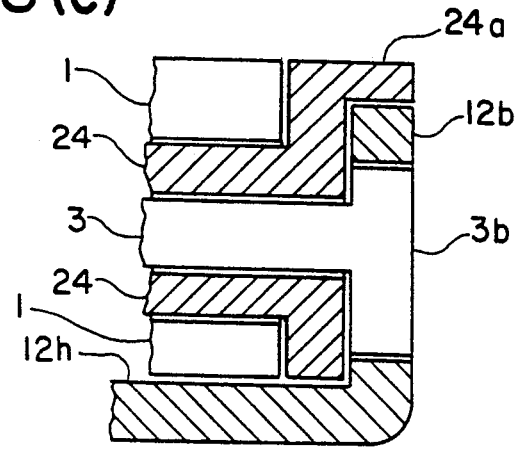

A pivot end 3b of the armature 3 is T-shaped and is inserted into a slot 12e vertically cut in the second bent end 12b of the first yoke 12 so that the armature 3 can pivotably swing about a longitudinal axis of the slot 12c, and along a direction parallel to the magnetization of the permanent magnet 6. The structure of the pivot end 3b of the armature 3 is shown in FIGS. 8(*a*)–8(*c*); that is, before and after the insertion of the armature 3 into the slot 12e, and after having the bobbin 24 mounted thereon. Thus, the other end 3a of the armature swings between the first bent end 12c and the second yoke 13, within the bobbin 24. Thus, the armature end 3a is referred to hereinafter as a swing pole.

Figure 6:
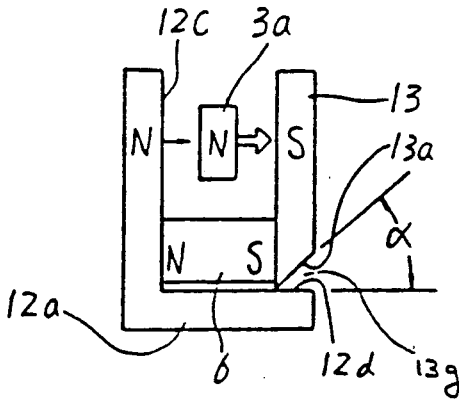
FIG. 6(*a*) schematically illustrates the magnetic polarization of each magnetic pole of FIG. 5, when the coil is not energized.
Figure 6:
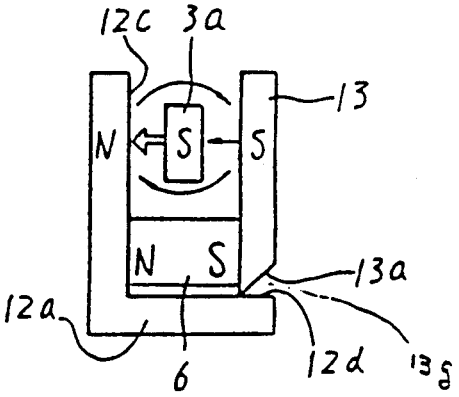

As shown in FIGS. 5, 6(*a*) and 6(*b*), lower end 13a of the second yoke 13 has taper of a cut angle $\alpha$, and the sharp edge of the taper 13a contacts the flat end 12a of the first yoke 12. The cut angle $\alpha$ of the taper 13a is typically in the range of 10°–30°.

Notches 12f, 12g, 13b and 13c, provided respectively, on the first bent end 12c, the flat end 12a and the second yoke 13 are for engaging the yokes 12 and 13 with the protruded part 24 *b* of the bobbin.

Referring to FIGS. 6(*a*) and 6(*b*), the permanent magnet 6 magnetizes the first bent end 12c as an N-pole, and the second yoke 13 as an S-pole. Accordingly, they are referred to hereinafter as N-pole plate and S-pole plate, respectively. There is an air gap 13g between the tapered edge 13a and a portion 12d of the first yoke 12. The air gap 13g produces a reluctance Rg between the S-pole plate 13 and the flat end 12a of the first yoke 12. The between the N-pole plate 12c and the flat end 12a, because the N-pole plate 12c and the flat end 12a are of one-piece, i.e. continuous. Therefore, the S-pole plate 13 has less magnetic effect on the first yoke 12h than does the N-pole plate 12c. Accordingly, the swing pole 3a is polarized an N-pole rather than a S-pole as shown in FIG. 6(*a*).

When no current is applied to the coil 1, i.e. when it is in a non-energized state, the swing pole 3a of the armature 3 is repulsed by the N-pole plate 12c and attracted by the S-pole plate 13 so as to contact the S-pole 13. In this state the magnetic flux flows in the magnetic circuit as shown by a dot-dash line in FIG. 7(*a*). As a result, the armature 3 pushes the card 14, which in turn pushes the moving-contact springs 27 onto a stationary contact 28.

Figure 7A:
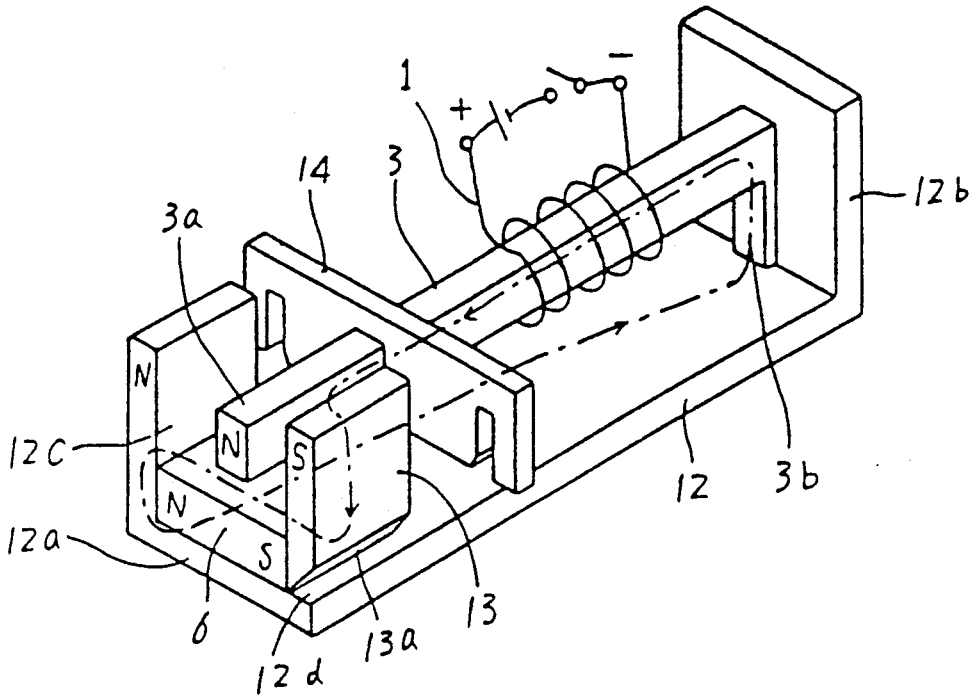
FIG. 7(*a*) schematically illustrates a path of magnetic flux in the magnetic circuit of FIG. 5 when the coil is not energized.
Figure 7B:
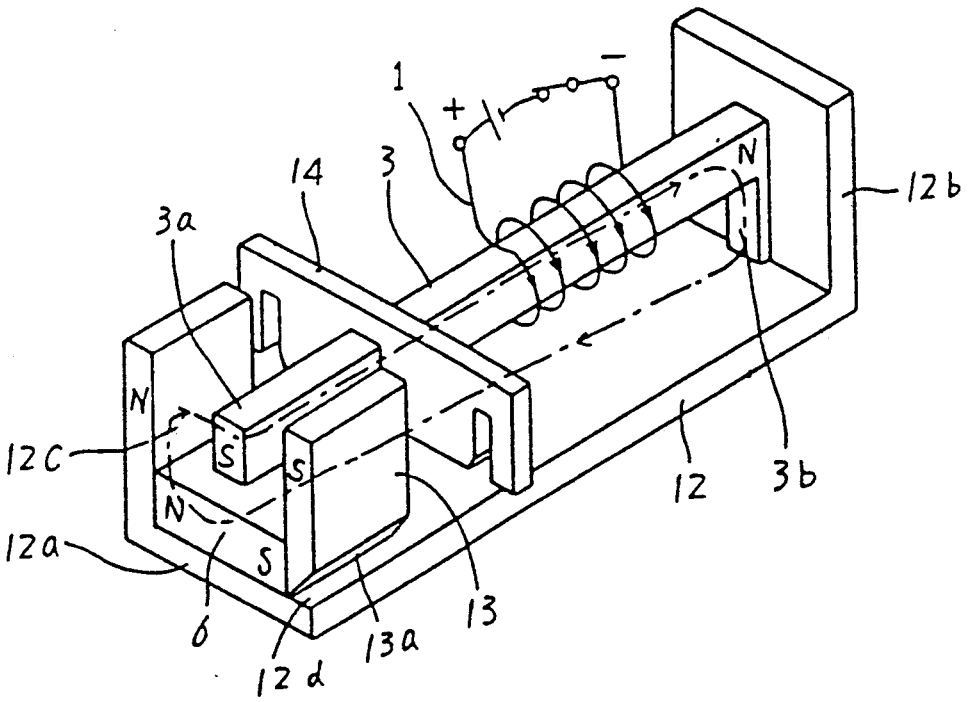

When the coil is energized, i.e., an adequate current in a direction indicated by arrows in FIG. 7(*b*) is applied to the coil 1 in order to overcome the effective magnetic force of permanent magnet 6, the swing pole 3a of the armature 3 becomes reversely polarized, i.e. as an S-pole. The first bent plate 12c remains polarized as an N-pole, and the second yoke 13 remains polarized as an S-pole. This is shown in FIG. 6(*b*) and by the dot-dash line of flux in FIG. 7(*b*). Accordingly, the swing pole 3a is repulsed by the S-pole plate 13 and attracted by the N-pole plate 12c so as to contact the N-pole plate 12c. Therefore, the card 14 laterally pushes the moving-contact springs 27 onto the stationary contacts 28 opposite the stationary contacts previously contacted when in the nonenergized state.

As described above, the magnetic circuit comprising the flat end 12a and the air gap 13g shunts the permanent magnet 6. Accordingly, the flat end 12a is referred to hereinafter as a shunt plate. The magnitude of the magnetic flux induced through the shunt plate 12a is controlled by reluctance Rg of the air gap 13g. The reluctance Rg is in series with the S-pole of the permanent magnet 6 and reluctance Rs of the shunt plate 12a itself. The magnitude of the reluctance Rg of the tapered gap portion depends on the area that the edge of the taper 13a contacts or that faces the shunt plate 12a, and depends on the angle $\alpha$ of the cut, i.e. the size of the air gap. In order to appropriately determine the reluctance value Rs of the shunt plate, the width of shunt plate 12a that is underneath the permanent magnet 6 is typically chosen to be narrower than the width of the permanent magnet 6. For example, shunt plate 12a would be underneath only 2 mm of a 3.6 mm wide permanent magnet as shown in FIG. 9, even through FIGS. 3, 5 and 7 show the permanent magnet 6 being coplanar with the shunt plate 12a.

In the above preferred embodiment of the polar relay, leakage magnetic flux (such as from N-pole to S-pole of prior art relay as shown with dotted lines 6b in FIG. 1(*c*)), is confined within the shunt plate 12a. In other words, the magnetic circuit in the structure of the present invention is closed. Therefore, the magnetic characteristics of the relay of the present invention are not affected by an external magnetic field. Furthermore, in the structure of the present invention, variation in the dimension of parts has a reduced effect on the magnetic characteristics of the relay in comparison. Accordingly, in the structure of the present invention, variations in the relay characteristics can be reduced by $\frac{1}{4}\sim\frac{1}{2}$ those occurring in the prior art relay.

The effect of the cut angle $\alpha$ of the taper is shown in the graph of FIG. 9. The FIG. 9 data is of a relay having a yoke with cross-section as shown in FIG. 9. That is, the shunt plate 12a covers only a 2 mm width of the 3.6 mm wide permanent magnet 6 which is 1.25 mm thick and 1.57 mm long along the direction of polarization; and the yokes are 0.8 mm thick. The curve in FIG. 9 represents an attractive force (gr) on the S-pole plate 13 while the coil current zero. As seen from the curve, as the air gap increases, the attractive force on the S-pole plate increases. It is apparent that the attractive force (gr) on the S-pole plate 13 may also be varied by varying the amount of the shunt plate 12a that underlies the permanent magnet 6.

Figure 10:
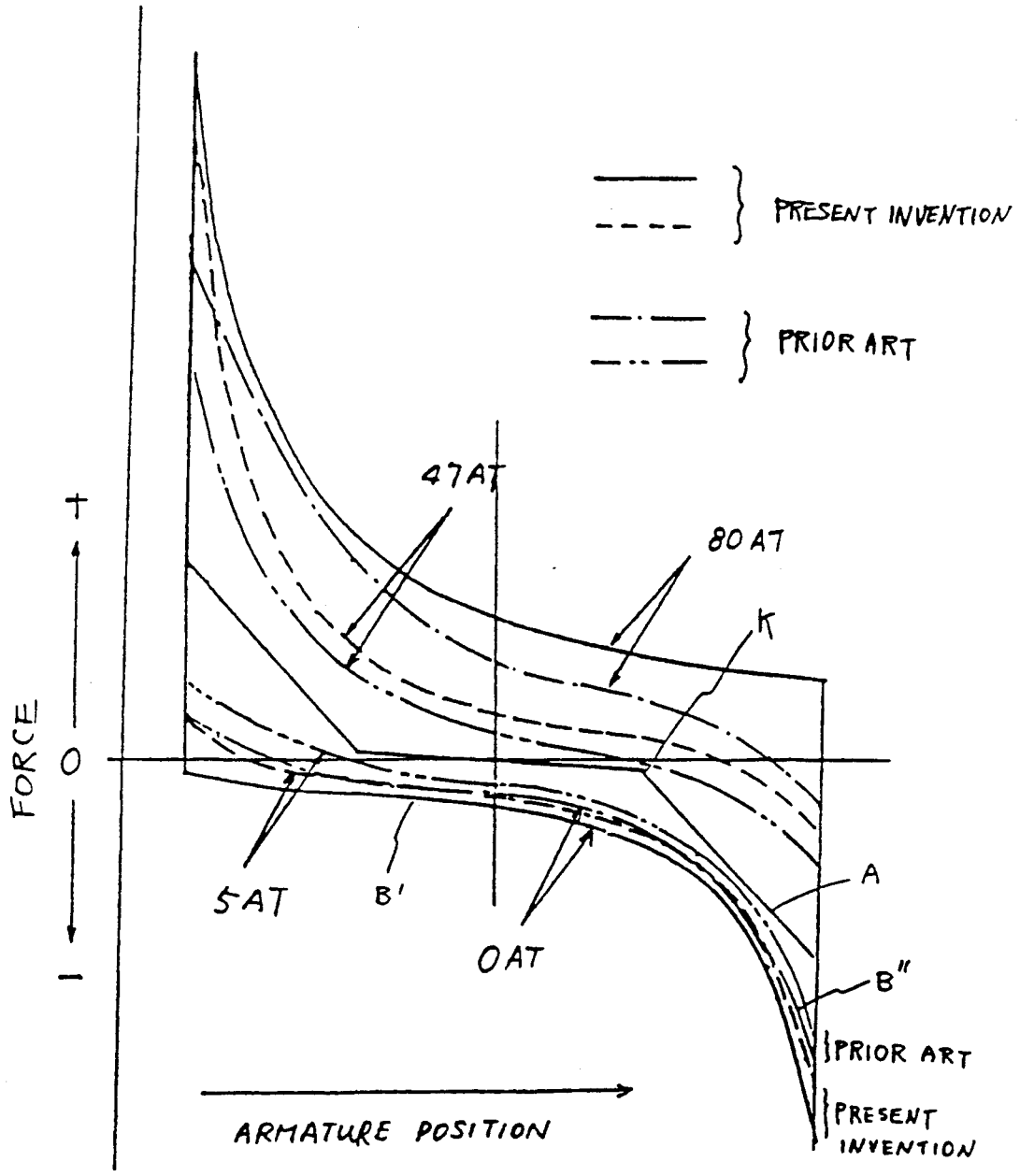
FIG. 10 is a graph showing mechanical forces in the relay versus armature position of the FIG. 3 embodiment of the present invention in comparison with prior art relay.

FIG. 10 is a graph showing mechanical forces magnetically induced in the relay versus the position of the armature in the FIG. 3 relay are shown in comparison with those of the prior art relay. In FIG. 10, the ampere-turns of the coil are varied. In the relay structure of the present invention, the majority of the resulting increase in margin is used to reduce the ampere-turns of the coil needed to break the swing pole from the S-pole plate. Some of the margin is used to increase the attractive force of the S-pole plate, i.e. the margin of curve B'. The ampere-turns needed to overcome the kink point K can be as small as 35 AT (ampere-turn) (which is not shown in the figure as a curve) compared to 47 AT of the prior art relay. If the permanent magnet 6 has a lower magnetic force and the structure of the present invention is not used, the 0 AT curve B" may touch the load curve A. However, according to the structure of the present invention the attractive force (gr) on the S-pole plate 13 can be kept almost same or a little higher than that of the prior art relay without having the 0 AT curve B' touch the load curve A. This is the case even with a remarkable reduction in the coil ampere-turns needed to break the swing pole 3a from the S-pole plate 13. As a result, with as few as 65 AT the structure of the present invention has an operation rating that compares with 80 AT of a prior art relay. This reduction of ampere-turns allows reduction of the coil power consumption from about 150 mW to about 100 mW.

Figure 11:
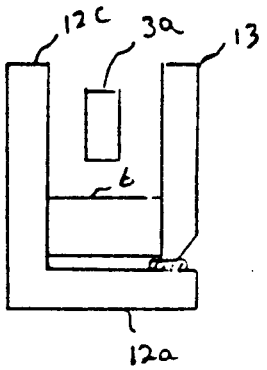
FIGS. 11(*a*)–(*f*) are cross-sectional views of variations of the high reluctance circuit formed between a pole of the permanent magnet and a main yoke in accordance with the present invention.
Figure 11:
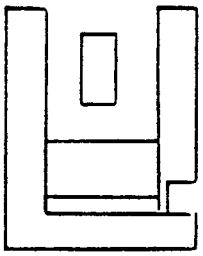
Figure 11:
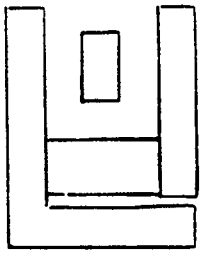
Figure 11:
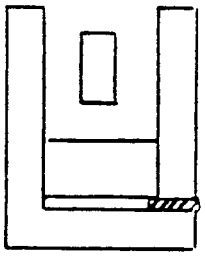
Figure 11:
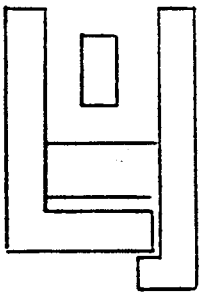
Figure 11:
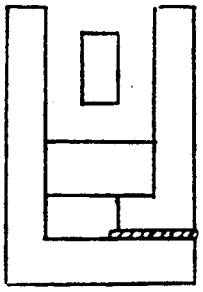

Variations in the structure of the high reluctance magnetic circuit at the lower edge of the second yoke 13 are shown in FIGS. 11(*a*) through 11(*f*). In FIGS. 11(*a*) and 11(*f*), the hatched portions denote spacers comprising a non-magnetic material, such as copper or plastic, which is magnetically equivalent to an air gap. The feature of each variation of the lower end of the second yoke 13 that faces the shunt plate 12*a* is self explanatory; thus requiring no more description.

Though in the above preferred embodiment of the present invention the polarization of the permanent magnet is such as shown in the figures, it is apparent that the invention can be embodied even if the polarization is reversed. In this case, the direction of the current application in the coil must be reversed.

The many features and advantages of the invention are apparent from the detailed specification; and thus, it is intended by the appended claims to cover all such features and advantages of the system which fall within the true spirit and scope of the invention. Further, since numerous modifications and changes may readily occur to those skilled in the art, it is not desired to limit the invention to the exact construction and operation shown and described, and accordingly, all suitable modifications and equivalents may be resorted to, falling within the scope of the invention.

We claim:

1. An electromagnetic polar relay comprising:

a first yoke having a main portion and first and second ends positioned at respective angles with respect to the main portion, said first end positioned with respect to said main portion to have a first magnetic reluctance between said first end and said main portion;

a second yoke, positioned to face said first end, having a lower end positioned to face the main portion and to have a second magnetic reluctance between said second yoke and said main portion that is larger than the first magnetic reluctance;

an armature having a first portion movably connected to the second end of said first yoke and having a second portion movable between said first yoke and said second yoke;

a coil positioned about said armature; and a permanent magnet, positioned over said main portion, having a first pole magnetically connected to the first end of said first yoke and a second pole magnetically connected to said second yoke.

2. An electromagnetic polar relay as recited in claim 1, wherein the lower end of said second yoke is tapered.

3. An electromagnetic polar relay as recited in claim 2, wherein an edge of the taper contacts said main portion.

4. An electromagnetic polar relay as recited in claim 2, wherein the edge of the taper is spaced from said main portion.

5. An electromagnetic polar relay as recited in claim 4, further comprising a nonmagnetic spacer between the edge of the taper and said main portion.

6. An electromagnetic polar relay as recited in claim 1, wherein only a portion of said permanent magnet is positioned over said main portion.

7. An electromagnetic polar relay recited in claim 1, further comprising:

a moving contact; and a card member engaged with said armature, for communicating movement of said armature to said moving contact.

8. An electromagnetic polar relay as recited in claim 1, wherein said coil is connected so that a current flows in said coil in a direction such that induced magnetic flux in the armature is reverse to an magnetic flux induced therein by said permanent magnet.

9. An electromagnetic polar relay as recited in claim 1, wherein the respective angles are approximately 90°.

10. An electromagnetic polar relay as recited in claim 1, wherein the first end of said first yoke is positioned in a plane that is substantially parallel to a longitudinal axis of the main portion.

11. An electromagnetic polar relay as recited in claim 1, wherein the second end of said first yoke is positioned in a plane that is substantially perpendicular to the main portion.

12. An electromagnetic polar relay as recited in claim 1, wherein the second end of said first yoke is bent substantially 90° from the main portion.

13. An electromagnetic polar relay as recited in claim 1, further comprising an air gap between the main portion and said permanent magnet.

14. An electromagnetic polar relay comprising:

a first yoke having a main portion in a first plane, a first protrusion in a second plane positioned at a first angle to the main portion and a second protrusion in a second plane positioned at a second angle to the main portion so that the first and second planes are at an angle with respect to each other, said first protrusion positioned with respect to said main portion to have a first magnetic reluctance between said first protrusion and said main portion;

a second yoke positioned in a third plane substantially parallel to the first plane, having a lower end positioned to face the main and to have a second magnetic reluctance between said second yoke and the main portion that is larger than the first magnetic reluctance;

an armature having a first portion movably connected to the second end of said first yoke and having a second portion movable between said first yoke and said second yoke;

a coil positioned about said armature; and a permanent magnet, positioned over the main portion so that only a part of said permanent magnet overlies the main portion, having a first pole magnetically connected to the first end of said first yoke and a second pole magnetically connected to said second yoke.

15. An electromagnetic polar relay as recited in claim 14, wherein said first and second angles are approximately 90°.

16. An electromagnetic polar relay according to claim 11, wherein said second end of said first yoke has a slot formed therein, and wherein said first portion of said armature comprises a protrusion extending substantially perpendicular to a longitudinal axis of said armature, said first portion of said armature including said protrusion being pivotably mounted within the slot.

* * * * *

UNITED STATES PATENT AND TRADEMARK OFFICE

CERTIFICATE OF CORRECTION

PATENT NO. : 5,150,090

DATED : SEPTEMBER 22, 1992

INVENTOR(S) : TAKASHI MIURA ET AL.

It is certified that error appears in the above-identified patent and that said Letters Patent is hereby corrected as shown below:

Col. 2, line 19, "$F_8$)" should be --$F_B$)--.

Col. 3, line 2, "an" should be --a--;
line 35, "FIG." should be --FIG. 3;--.

Col. 5, line 31, "The between" should be --The reluctance Rg is higher than the reluctance between--.

Col. 8, line 10, "an" should be --a--;
line 40, "main and" should be --main portion and--.

Signed and Sealed this

Twenty-sixth Day of October, 1993

*Attest:*

*Attesting Officer*

BRUCE LEHMAN

*Commissioner of Patents and Trademarks*